US009828198B2

(12) United States Patent
Li

(10) Patent No.: US 9,828,198 B2
(45) Date of Patent: Nov. 28, 2017

(54) PAPER STOP STRUCTURE, PAPER FEED UNIT, AND IMAGE FORMING APPARATUS

(71) Applicant: Zhuhai Seine Technology CO., Ltd., Zhuhai (CN)

(72) Inventor: Yang Li, Zhuhai (CN)

(73) Assignee: ZHUHAI SEINE TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 15/424,954

(22) Filed: Feb. 6, 2017

(65) Prior Publication Data

US 2017/0144851 A1 May 25, 2017

Related U.S. Application Data

(63) Continuation of application No. PCT/CN2015/083225, filed on Jul. 2, 2015.

(30) Foreign Application Priority Data

Aug. 8, 2014 (CN) ..... 2014 1 0391100

(51) Int. Cl.
*B65H 3/06* (2006.01)
*B65H 9/06* (2006.01)

(52) U.S. Cl.
CPC ..... *B65H 3/0684* (2013.01); *B65H 9/06* (2013.01); *B65H 2301/4222* (2013.01)

(58) Field of Classification Search
CPC ..... B65H 3/0684; B65H 9/046
(Continued)

(56) References Cited

U.S. PATENT DOCUMENTS 6,349,931 B1 2/2002 Kuo et al.
6,792,241 B2 * 9/2004 Nakagawa ..... G03G 15/602 271/117

(Continued)

FOREIGN PATENT DOCUMENTS

CN 2716219 Y 8/2005
CN 2887804 Y 4/2007

(Continued)

OTHER PUBLICATIONS

The World Intellectual Property Organization (WIPO) International Search Report for PCT/CN2015/083225 dated Sep. 24, 2015 p. 1-6.

*Primary Examiner* — Patrick Cicchino
(74) *Attorney, Agent, or Firm* — Anova Law Group, PLLC

(57) ABSTRACT

The present disclosure provides a paper stop structure, a paper feed unit, and an image forming apparatus. The paper stop structure includes a movement stopper and a paper stopper both swingably configured in a paper feed path, and a separation structure to separate the movement stopper and the paper stopper. In paper stopping state, the paper stopper is pushed by an external force to swing until contacting the movement stopper, and blocks paper sheets from entering the paper feed path. In non-paper stopping state, the paper stopper is pushed by an external force to swing and separates from the movement stopper. Accordingly, various functions of paper feeding, paper stopping, and paper detecting may be achieved, and large capacity paper feeding can also be achieved to improve product operating efficiency and to effectively prevent paper mis-feed and paper jam during the image forming apparatus operation.

17 Claims, 8 Drawing Sheets

(58) Field of Classification Search
USPC ..... 271/171
See application file for complete search history.

(56) References Cited

U.S. PATENT DOCUMENTS

| | | | | |
|---|---|---|---|---|
| 7,516,953 | B2 * | 4/2009 | Lee | B65H 3/0684 271/117 |
| 7,543,811 | B2 * | 6/2009 | Shimamura | B65H 3/56 271/117 |
| 7,837,188 | B2 * | 11/2010 | Lee | B65H 3/0684 271/117 |
| 8,052,137 | B2 * | 11/2011 | Chung | B65H 3/0684 271/117 |
| 8,052,139 | B1 * | 11/2011 | Su | B65H 3/0684 271/109 |
| 8,096,547 | B1 * | 1/2012 | Huang | B65H 3/0684 271/117 |
| 8,231,122 | B2 * | 7/2012 | Tu | B65H 3/0684 271/117 |
| 8,317,186 | B2 * | 11/2012 | Lai | B65H 3/0684 271/110 |
| 9,233,808 | B2 * | 1/2016 | Morimoto | B65H 3/0684 |
| 9,266,691 | B2 * | 2/2016 | Morimoto | B65H 1/26 |
| 2008/0054549 | A1 * | 3/2008 | Lee | B65H 3/0615 271/117 |
| 2010/0225977 | A1 * | 9/2010 | Osanai | B65H 1/04 358/474 |
| 2010/0244368 | A1 * | 9/2010 | Lin | B65H 3/0684 271/121 |
| 2014/0374984 | A1 * | 12/2014 | Morimoto | B65H 1/26 271/117 |

FOREIGN PATENT DOCUMENTS

| | | | |
|---|---|---|---|
| CN | 104199262 | A | 12/2014 |
| CN | 204124862 | U | 1/2015 |

* cited by examiner

PAPER STOP STRUCTURE, PAPER FEED UNIT, AND IMAGE FORMING APPARATUS

CROSS-REFERENCES TO RELATED APPLICATIONS

This application claims priority of International Patent Application No. PCT/CN2015/083225, filed on Jul. 2, 2015, which claims priority of Chinese Application No. 201410391100.1, filed on Aug. 8, 2014, and the entire contents of all of above applications are hereby incorporated by reference.

FIELD OF THE DISCLOSURE

The present disclosure generally relates the image forming technology and, more particularly, relates to a paper stop structure, a paper feed unit, and an image forming apparatus.

BACKGROUND

With the growing popularity of image forming apparatuses such as printers in the work and daily life, people become less content with using single-function image forming apparatuses. For example, the hybrid printers may provide multiple functions such as scanning, printing, and copying, etc., such that it is no longer necessary to place multiple separate apparatuses with different functions in the office space. Such arrangement saves the work space, reduces the business operation cost, and increases the employee work efficiency and quality.

Such a multi-function printer can be created based on a printer with only the printing function by adding a scanning device and a paper feed device that feeds paper to the scanning device to achieve the scanning function and the copying function, etc. The paper feed device is often located above the scanning device. Due to lack of paper handling structure such as paper cassette or paper guide in such paper feed device, paper sheets are likely to get into the paper feed path, causing damages to the front of paper sheets, and multiple paper sheets are likely to be fed into the printer together.

To solve the above described problems, a paper stop structure is often used in the conventional printers. FIG. 1 illustrates a schematic diagram of a conventional paper feed device of multi-function printers. As shown in FIG. 1, the paper feed device includes a paper feed structure 1, and a paper stop structure 2 configured at the paper entry of the paper feed structure.

When the printer is not in operation, paper sheets are blocked by the paper stop structure 2 from entering the paper feed path. When the printer is in operation, the paper stop structure 2 lifts up and the paper feed structure 1 draws paper sheets into the paper feed path. Specifically, the paper feed device also includes a connection rod 3 connecting the paper feed structure 1 and the paper strop structure 2. The connection rod 3 is swingably and pivotally mounted under an upper cover of the printer, and has a first connection member 5 and a second connection member 6. The first connection member 5 connects to the paper feed structure 1 and the second connection member 6 connects with the paper stop structure 2. The paper feed structure 1 and the paper stop structure 2 are connected by the connection rod 3 and move in opposite directions.

However, the paper stop structure 2 in the paper feed device only proves up and down, and the range of the movement is limited by the paper feed structure 1 and the upper cover. It is often impossible to feed a large number of paper sheets. As such, the paper feed capability of the paper feed device is limited, and the product applicability is also limited.

BRIEF SUMMARY OF THE DISCLOSURE

In order to solve the above-described technical problems, the present invention provides a paper stop structure for an image forming apparatus. The paper stop structure includes a movement stopper swingably configured in a paper feed path; a paper stopper swingably configured in the paper feed path; and a separation structure configured to separate the movement stopper and the paper stopper. When the paper stop structure is in a paper stopping state, the paper stopper is pushed by an external three to swing until the paper stopper comes into contact with the movement stopper, stops swinging, and blocks paper sheets from entering the paper feed path. When the paper stop structure is not in the paper stopping state, the paper stopper shed by an external force to swing, and separates itself from the movement stopper.

The present invention also provides paper feed unit for image forming apparatus. The paper feed unit includes a press cover with a lid hinged to the press cover, a paper feed roller holder being configured, on the lid; a conveying frame coupled with the press cover and the lid to form a paper feed path; and a paper stop structure. The paper stop structure includes a movement stopper swingably configured in a paper feed path; a paper stopper swingably configured in the paper feed path; and a separation structure configured to separate the movement stopper and the paper stopper. When the paper stop structure is in a paper stopping state, the paper stopper is pushed by an external force to swing until the paper stopper comes into contact with the movement stopper, stops swinging, and blocks paper sheets from entering the paper feed path. When the paper stop structure is not in the paper stopping state, the paper stopper is pushed by an external force to swing, and separates itself from the movement stopper. Further, the movement stopper is hinged to the lid by movement stopper pivot shafts located on both sides of the movement stopper; the paper stopper is attached to the conveying frame through paper stopper pivot shafts located on both sides of the paper stopper; the movement stopper operates in coordination with the paper feed roller bolder through a guide structure; and an end of the movement stopper is pulled by the paper feed roller holder to swing.

The present invention also provides an image forming apparatus, including an image forming unit, a scanning unit, and a paper feed unit described above for feeding paper sheets to the scanning unit. The scanning unit is located above the image forming unit. The paper feed unit is located above the scanning unit. The press cover of the paper feed unit rotates to cover the scanning unit.

According to the disclosed embodiments, various functions including paper feeding, paper stopping, and paper detecting can be achieved. Further, large capacity paper feeding can also be achieved to improve the operating efficiency of the product and to effectively prevent the occurrences of paper mis-feed and paper jam during the operation of an image firming apparatus such as a printer.

Other features and advantages of the present invention will be described in the subsequent specification, and in part, will be obvious from the specification, or may be learned from the embodiments of the present invention. The objectives and other advantages of the present invention may be realized and attained by the structures and/or processes particularly pointed out in the specification, the claims, and the accompanying drawings.

DETAILED DESCRIPTION

Various embodiments of the present invention will be described in detail with reference to the accompanying drawings and examples to illustrate how to apply and implement the technical methods of the present invention to solve the technical problems and achieve the corresponding technical effects. The embodiments and the respective features of the embodiments can be combined with each other under the condition that no conflicts exist, and the resulting technical solutions are within the scope of the present invention.

In addition, the steps illustrated in the flow charts of the drawings may be a set of computer-executable instructions executed in a computer system. Also, while logic orders are illustrated in the flow charts, under certain circumstances, the steps may be performed in orders different from shown and described in the flow charts.

Figure 1:
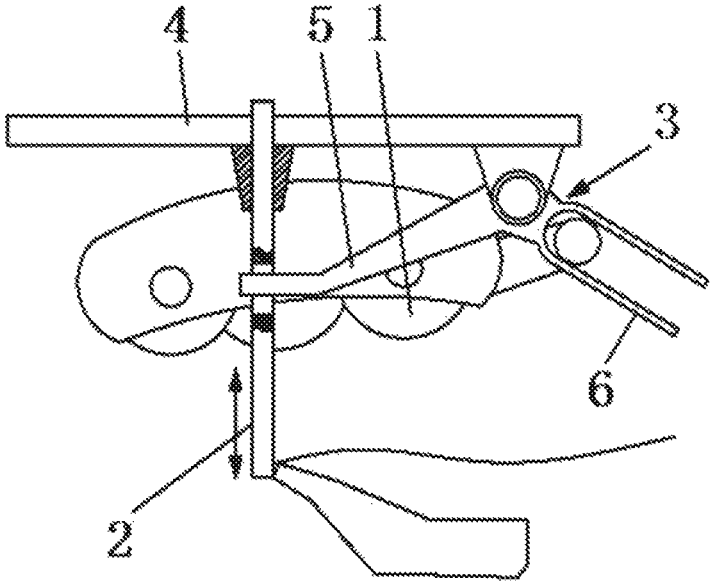
FIG. 1 (Prior art)
FIG. 1 illustrates a schematic diagram of a conventional paper stop structure.
Figure 2:
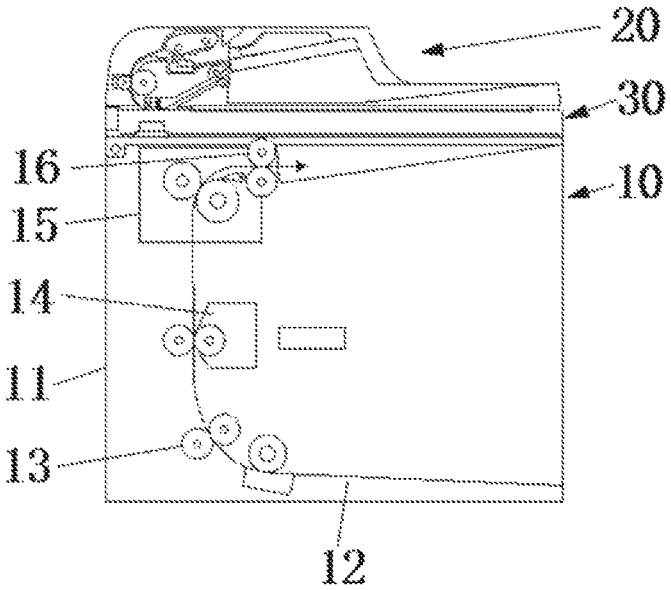
FIG. 2 illustrates a schematic diagram of an exemplary multi-function image forming apparatus according to the disclosed embodiments.

FIG. 2 illustrates a schematic diagram of an exemplary multi-function image forming apparatus according to the present disclosure. As shown in FIG. 2, the multi-function image forming apparatus includes an image forming unit 10, a scanning unit 30, and a paper feed unit 20 for feeding paper sheets to the scanning unit 30.

The image forming unit 10 includes an enclosure 11, a paper tray 12 disposed inside the enclosure 11, a paper feed device 13, an image forming device 14, an image fixer device 15, and a paper discharge device 16, etc. In operation, the paper feed device 13 draws a paper sheet from the paper tray 12 and feeds the paper sheet into the image forming device 14. The image forming device 14 includes a photosensitive drum, a charging roller, a developing roller, a powder feeding roller, and a transfer roller, etc. These parts are coordinated to act together to transfer the toner onto the paper sheet. Then, the toner image is fixed on the paper sheet by the image fixer device 15. The paper sheet is pushed out of the enclosure 11 by the paper discharge device 16.

When a user selects a single sheet scanning copy function, the original paper sheet may be placed directly on the scanner of the scanning unit 30. The scanner scans the image information and transmits the image information to the system. The image forming unit 10 in the system prints the scanned image information onto a copy paper sheet.

When a user selects a multiple sheet scanning copy function, a plurality of original paper sheets may be placed in the paper feed unit 20. The paper feed unit 20 allows the user to automatically send the plurality of the original paper sheets to be copied to the scanning unit 30 for continuous scanning operation. The image forming unit 10 prints the scanned image information onto a plurality of copy paper sheets. The paper feed unit 20 facilitates the multiple sheet scanning copy function in an easy and efficient manner.

The structure and operation of the paper feed unit 20 will be described in further details with reference to FIGS. 2 and 3.

As shown in FIG. 2, the scanning unit 30 is disposed above the image forming unit 10, and the paper feed unit 20 is disposed above the scanning unit 30.

Figure 3:
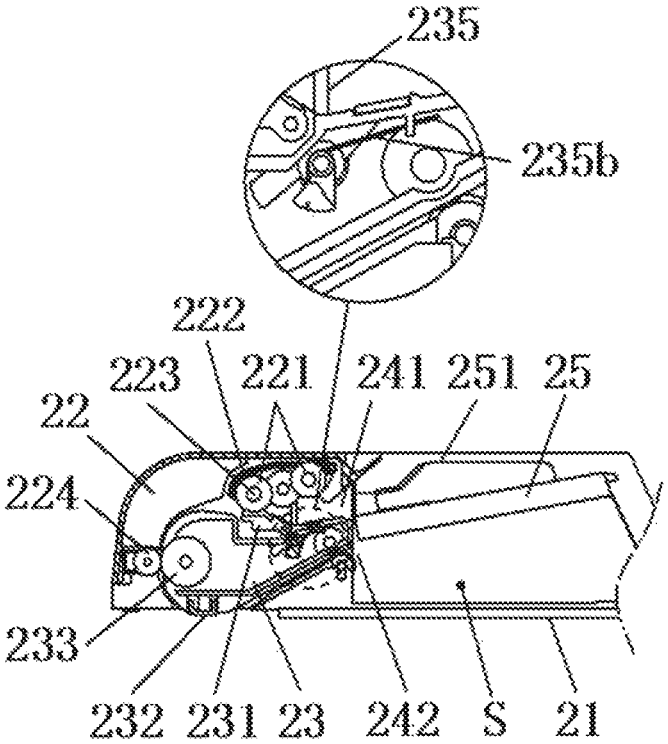
FIG. 3 illustrates a cross-sectional diagram of internal structures of a scanning unit and a paper feed unit of an exemplary image forming apparatus according to the disclosed embodiments.

As shown in FIG. 3, the paper feed unit 20 includes a press cover 21. The press cover 21 may be rotated to cover the top of the scanning unit 30. The paper feed unit 20 also includes a lid 22 hinged to the press cover 21, and a conveying frame 23 fixedly mounted on the press cover 21. The press cover 21, the lid 22, and the conveying frame 23 are enclosed together to form a paper feed path 24 (referring to FIG. 4*c*).

The lid 22 is hinged to the end of the press cover 21, and can be flipped open on the press cover 21. When the lid 22 is closed, the conveying frame 23 is covered by the lid 22, and is not exposed. When the lid 22 is opened, the conveying frame 23 is exposed.

The paper feed path 24 is often in a C-shape. The upper and lower ends of the paper feed path 24 are a paper entry opening 241 and a paper exit opening 242, respectively. The paper entry opening 241 includes a paper feed roller set for drawing paper sheets into the paper feed path 24. The paper feed roller set includes a paper feed roller 221 which feeds paper sheets one at a time and prevents feeding multiple paper sheets. A paper feed roller holder 222 is configured on the lid 22 to hold the paper feed roller 221.

A driving shaft 223 is configured on the lid 22 to drive the paper feed roller 221 to rotate. An electric motor is configured on the side of the press cover 21 to drive the driving shaft 223 to rotate. When the lid 22 is opened, the driving shaft 223 is separated from the electric motor, and loses the driving force. The paper feed roller holder 222 moves away from or closer to the conveying frame 23 when the lid 22 is flipped open or close. When paper jam occurs, the operator may flip open the lid to easily remove the jammed paper sheets.

A paper tray 25 is configured outside the paper entry opening 241. Sliding paper guides 251 are configured on the paper tray 25. The paper guides 251 are able to restrict the paper sheets position in the paper tray 25 when entering the paper feed path 24 to prevent the paper sheets from entering the paper feed path 24 unaligned, causing paper jam. The paper guides 251 not only restrict the width position of the paper sheets, but also restrict the paper stack height in the paper tray, thus avoiding excessive number of paper sheets entering the paper feed path 24 and causing paper jam. Also, if the paper stack height exceeds the operation height of the paper stop structure of the paper feed unit 20, it is likely to damage the image forming apparatus.

A separator 23*i* is configured on the conveying frame 23. The separator 231 operates together with the paper feed roller 221. When two paper sheets are drawn by the paper feed roller 221, the separator 231 may apply a fiction force to the bottom sheet, which is greater than a fiction force between two paper sheets, but smaller than a fiction force between the paper feed roller 221 and a paper sheet. Thus, the paper feed roller 221 is guaranteed to draw one paper sheet at a time, and mis-feeds and redundant feeds are unlikely to occur.

A presser 232 is configured at the bottom of the conveying frame 23. A spring is interposed between the presser 232 and the conveying frame 23. When a paper sheet passes the presser 232 in the paper feed path 24, the spring force presses on the presser 232. Pressed by the spring force, the presser 232 presses the paper sheet surface that needs scanning tightly against the scanner, preventing unclear image being scanned.

A conveying roller set is configured in the paper feed path 24 to convey paper sheets. The conveying roller set includes a first conveying roller 224 configured on the lid 22, and a second conveying roller 233 configured on the conveying frame 23. When paper jam occurs and the lid 22 is opened, the first conveying roller 224 moves with the lid 22, and separates from the second conveying roller 233 so that the paper sheets jammed between the first conveying roller 224 and the second conveying roller 233 can be easily removed.

The scanning unit 30 and the paper feed unit 20 may be operated as follows. An operator places the image papers that need to be copied at the paper entry opening 241, and the paper feed roller 221 draws the paper sheets into the paper feed path 24. The separator 231 can guarantee only one paper sheet at a time enters into the paper feed path 24. The conveying roller set provides further driving force to convey the paper sheet to the presser 232 located under the conveying frame 23. The presser 232 presses the paper sheet against the scanner. At this time, driven by the force of the conveying roller set, the paper sheet continues to move forward until the paper sheet reaches the paper exit opening 242 of the paper feed path 24. A sheet discharge roller is configured at the paper exit opening 242. After the paper sheet is separated from the conveying roller set, the sheet discharge roller timely catches the paper sheet, and continues to drive the paper sheet forward until the paper sheet exits the paper feed path 24 and falls into a region S located on the press cover 21 and configured for holding paper sheets.

Figure 4A:
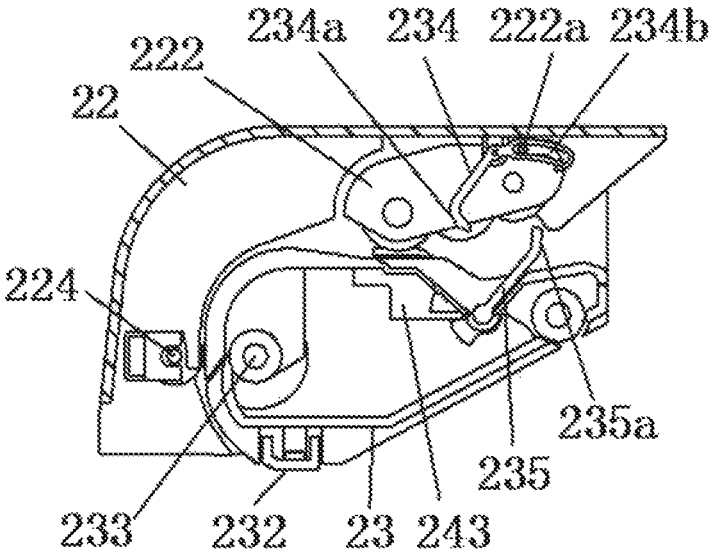
FIG. 4*a* illustrates a schematic diagram of an initial state of an exemplary paper stopper according to the disclosed embodiments.

The structure and operation principle of the paper stop structure of the paper feed unit 20 are described with reference to FIGS. 4*a*-4*c*, together with FIG. 2 and FIG. 3.

In one embodiment, the paper stop structure may include a movement stopper 234 and a paper stopper 235. Other structures may also be included. The movement stopper 234 is hinged to the lid 22 by a movement stopper pivot shaft 234*c*, and swings around the movement stopper pivot shaft 234*c*. The paper stopper 235 is mounted on the conveying frame 23 by a paper stopper pivot shaft 235*c*, and swings around the paper stopper pivot shaft 235*c*. The movement stopper 234 and the paper stopper 235 swing in the opposite directions, respectively.

A first end of the movement stopper 234 is a hook 234*a*. The hook 234*a* forms an angle of less than 180 degrees with respect to the main body of the movement stopper 234. A first end of the paper stopper 235 is a hook 235*a* corresponding to the hook 234*a* of the movement stopper 234. The hook 235*a* forms an angle of less than 180 degrees with respect to the main body of the paper stopper 235. The hook 234*a* and the hook 235*a* hook up with each other, that is, the inner sides of the two angles contact with each other.

The paper stopper structure also includes a separation structure that keeps the movement stopper 234 and the paper stopper 235 separated from each other. In one embodiment, the separation structure is a torsion spring 235*b* which encloses the paper stopper pivot shaft 235*c* (as shown in FIG. 5*b*). The torsion spring 235*b* supports the paper stopper 235 to keep the hook 234*a* and the hook 235*a* hooked up with each other when neither movement stopper 234 nor the paper stopper 235 is subject to external forces. The separation structure may be an elastic spring. One end of the elastic spring is connected to the paper stopper 235 and the other end of the elastic spring, is connected to the conveying frame 23.

In one embodiment, the paper feed roller holder 222 is mounted on the lid 22 by a driving shaft 223. The paper feed roller 221 is mounted on the paper feed roller holder 222. The movement stopper 234 is hinged to the lid 22. A second end of the movement stopper 234 may be pulled by the paper feed roller holder 222 to swing.

A guide protrusion 222*a* is configured outside the paper feed roller holder 222. A guide slot 234*b* is configured on the movement stopper 234, corresponding to the guide protrusion 222*a*. The guide protrusion 222*a* and the guide slot 234*b* may be coupled together to form a guide structure. When the paper feed roller holder 222 swings, the guide protrusion 222*a* cooperates with the guide slot 234*b* to cause the movement stopper 234 to form a lever structure to start swinging. Of course, the guide protrusion 222*a* and the guide slot 234*b* may switch positions. That is, the guide protrusion 222*a* is configured on the movement stopper 234, and the guide slot 234*b* is configured on the paper feed roller holder 222. Such arrangement operates in the same way. Of course, the movement stopper 234 may be driven by a separate driving structure to swing. Thus, in the embodiments of the present disclosure, the coordinated driving method using the paper feed roller older 222 is a preferred method.

The paper stopper 235 mounted on the paper stopper, pivot shaft 235*c* swings in the paper feed path 24. In one embodiment, as shown in FIG. 4*a*, when the paper sheet enters the paper feed path 24, the paper stopper 235 rotates in a counter clockwise direction while the movement stopper 234 rotates in a clockwise direction to release the resistance to the paper stopper 235.

One end of the torsion spring 235*b* connected to the paper stopper 235 and the other end is connected to the conveying frame 23. The torque force of the torsion spring 235*b* keeps the paper stopper 235 to remain in a first position in absence of other external forces. The torque force of the torsion spring 235*b* may be properly adjusted such that the torsion spring 235*b* does not rotate due to the gravity force, and when only one paper sheet enters the paper feed path 24, the paper stopper 235 is in motion as driven by the paper sheet. After the paper sheet completely passes through the paper stopper 235, the torsion spring 235*b* is able to overcome the weight of the paper stopper 235 to reset the paper stopper 235 to the first position.

The paper stopper 235 has three different states. When the paper stopper 235 is located at the first position as shown in the FIG. 4*a*, the paper stopper 235 is in a non-operating state. In absence of other external forces, as driven by the torque force of the torsion spring 235*b*, the paper stopper 235 remains in the non-operating state. When driven reversely by an electric motor, the paper feed roller holder 222 assumes a position close to the top of the lid 22, and the hook 234*a* of the movement stopper 234 is located at the lowest position. At this time, the movement stopper 234 is located at a first position.

Figure 4B:
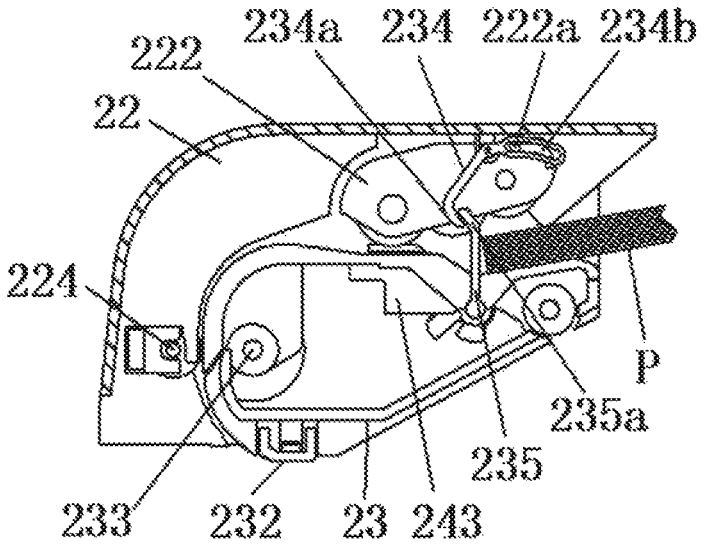
FIG. 4*b* illustrates a schematic diagram of a state of an exemplary paper stopper while a paper sheet entering a paper feed path according to the disclosed embodiments.
Figure 4C:
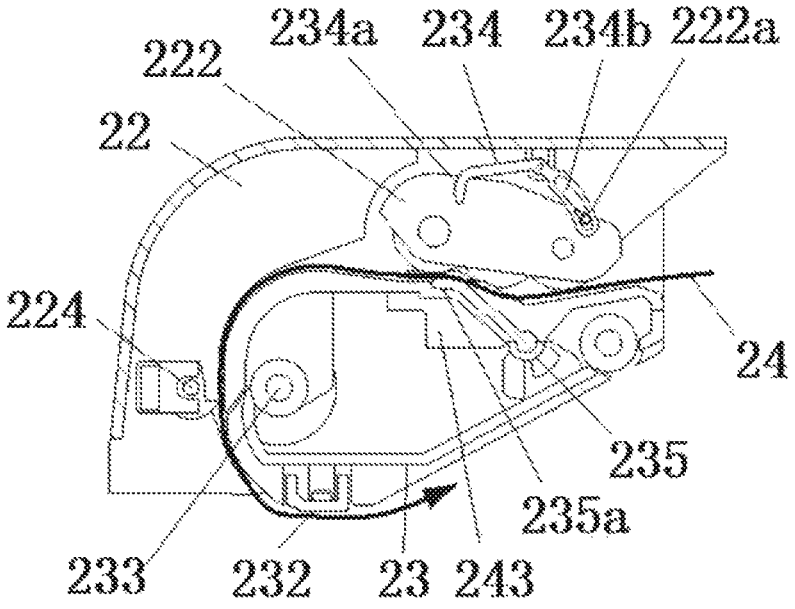
FIG. 4*c* illustrates a schematic diagram of a state of an exemplary paper stopper while a paper sheet passing through a paper feed path according to the disclosed embodiments.

When the paper tray 25 is loaded with paper sheets and the hook 235*a* of the paper stopper 235 is pushed and stopped by the hook 234*a* of the movement stopper 234, the paper stopper 235 is located at a second position, as shown in FIG. 4*b*. When the paper stopper 235 is located in the second position, at least one paper sheet has entered the paper feed path 24. A paper sheet P pushes the paper stopper 235 forward. At this time, the paper feed roller holder 222 does not swing, and neither does the movement stopper 234. The movement stopper 234 remains at the first position. The hook 235*a* of the paper stopper 235 is stopped by the hook 234*a* of the movement stopper 234 from moving forward. Thus, the paper sheet P is stopped at the entry opening of the paper feed path 24.

A sensor 243 is configured, in the paper feed path 24 to sense the position change of the paper stopper 235. When the paper stopper 235 changes its position, the sensor 243 sends a signal to the system to indicate that a paper sheet P enters the paper feed path 24. After receiving the signal, the system starts the electric motor to drive the driving shaft 223 to rotate. Driven by the driving shaft 223, the paper feed roller holder 222 swings downward to make the paper feed roller 221 contact the paper sheet P. At the same time, the movement stopper 234 swings in coordination with the paper feed roller holder 222's swinging movement. The hook 234*a* of the movement stopper 234 swings upward, causing the movement stopper 234 to assume the second position, and releasing itself from the paper stopper 235. Thus, in one embodiment, the paper stopper 235 not only stops the paper sheets, but also senses the presence of the paper sheets.

The paper feed roller 221 continues to rotate to convey the paper sheet P further into the paper feed path 24. The paper stopper 235 loses the resistance from the movement stopper 234, and, when pushed by the paper sheet P, swings to a third position as shown in FIG. 4*c*, which is located under the paper sheet P. The paper stopper 235 resumes to the first position after the paper sheet P completely passes through the paper stopper 235. At this time, the sensor 243 senses the position change of the paper stopper 235, and sends a signal to the system to indicate the absence of a paper sheet in the paper feed path 24. The system inverts the electric motor to drive the driving shaft 223 to swing the paper feed roller holder 222 upward to a position close to the lid 22 position. At the same time, driven by the paper feed roller holder 222, the movement stopper 234 swings so that the hook 234*a* swings downward to the lowest position, and blocks the swinging path again for the paper stopper 235.

The cooperation relationship between the movement stopper 234 and the paper stopper 235 is described in the following with reference to FIGS. 5*a*-5*e* and FIGS. 2-4*c*.

Figure 5A:
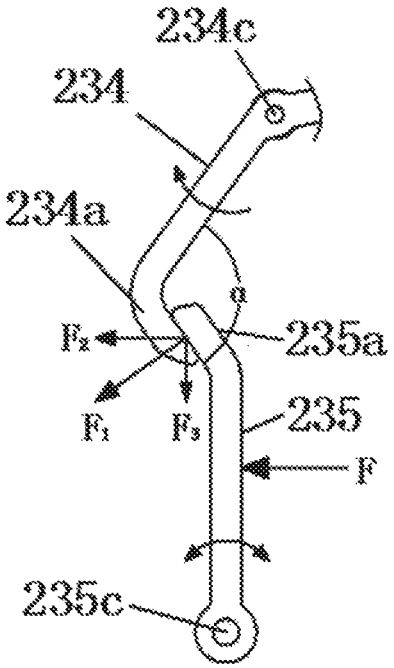
FIG. 5*a*-5*e* illustrate schematic diagrams of coordination between a movement stopper and a paper stopper according to the disclosed embodiments.
Figure 5B:
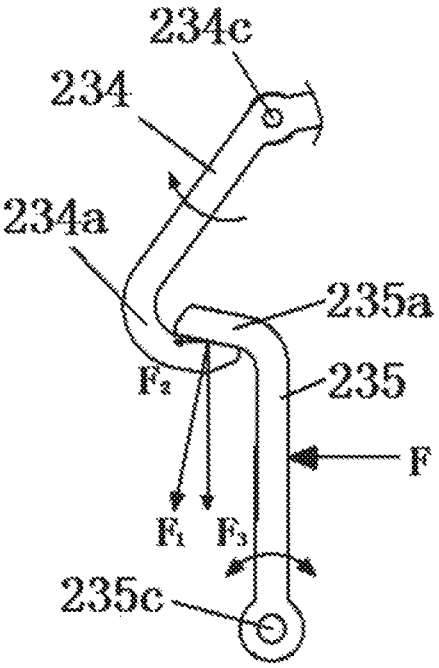
Figure 5C:
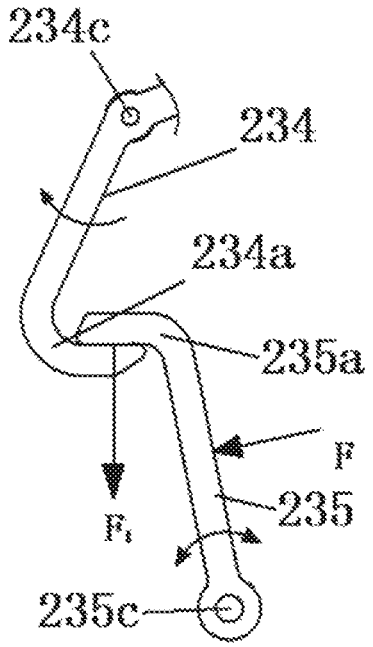

FIGS. 5*a*-5*c* illustrate schematic diagrams of an exemplary force analysis of the movement stopper 234 and the paper stopper 235. The hook 234*a* and the hook 235*a* are configured facing toward each other. When the movement stopper 234 contacts the paper stopper 235, the inner sides of the angles of the hook 234*a* and the hook 235*a* contact with each other. When the hook 234*a* and the hook 235*a* hook up facing with each other, a surface of the hook 234*a* facing toward the hook 235*a* contacts with a surface of the hook 235*a* facing toward the hook 234*a*, which effectively makes the cooperation between the movement stopper 234 and the paper stopper 235 tighter. Of course, when the hook 234*a* and hook 235*a* hook up facing with each other, the hook 234*a* and the hook 235*a* could also have a line contact. For example, an edge of the hook 234*a* closest to the hook 235*a* contacts the surface of the hook 235*a* facing toward the hook 234*a*, or an edge of the hook 235*a* closest to the hook 234*a* contacts the surface of the hook 234*a* facing toward the hook 235*a*. Of course, it is also possible that hook 234*a* and the hook 235*a* have multiple points of contact with each other.

When a paper sheet P is drawn into the paper entry opening 241, a thrust F from the paper sheet P is applied to the paper stopper 235. Then, a force F1 is applied to the contact surface between the movement stopper 234 and the paper stopper 235 from the paper stopper 235. The force F1 is perpendicular to the contact surface between the movement stopper 234 and the paper stopper 235, and can be decomposed into a horizontal component F2 and a perpendicular component F3. In one embodiment, as shown in FIG. 5*a*, under a certain force F1, a horizontal component F2 is relatively large, and the hook 234*a* may not be able to hook up the paper stopper 235, causing the hook 234*a* to disengage.

As shown in FIGS. 5*b* and 5*c*, the horizontal component F2 of the force F1 is very small or negligible, and the hook 234*a* is able to easily hook up with the paper stopper 235. As such, in order to make the paper stop structure more stable, when the thrust F is applied to the paper stopper 235 by the paper sheet P, the horizontal component F2 of the force F1 that movement stopper 234 applies to the contact surface of the paper stopper 235 should be as small as possible or negligible while the vertical component F3 should be as large as possible or almost same as the force F1.

Figure 5D:
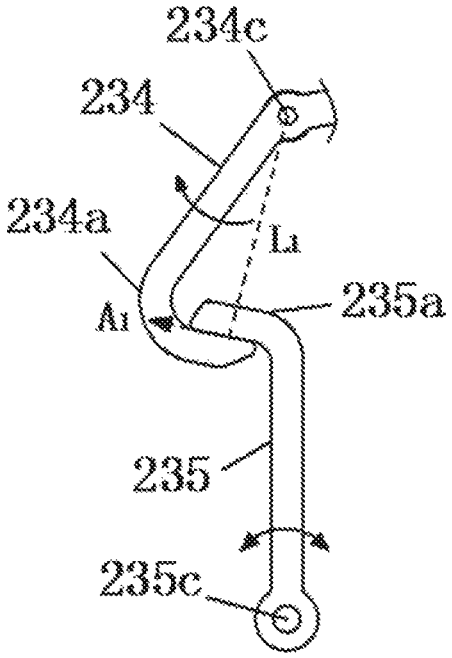
Figure 5E:
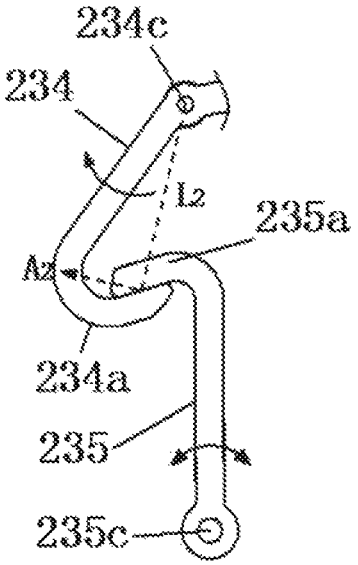

In addition, in order to increase the strength of the movement stopper 234 to block the paper stopper 235, the distance between the contact surface of the movement stopper 234 and the paper stopper 235 and the movement stopper pivot shaft 234*c* should be as short as possible. On one hand, it can be achieved by shortening the length of the movement stopper 234. On the other hand, it can be achieved by reducing the hook angle $\alpha$ of the hook 234*a*. But, it is not true that the smaller the angle $\alpha$, the better. In one embodiment, FIGS. 5*d* and 5*e* illustrate the schematic diagrams of the engagement between the movement stopper 234 and the paper stopper 235 in the cases of two different angles $\alpha$. As shown in FIGS. 5*d* and 5*e*, L1 and L2 are lines connecting the axis of the movement stopper pivot shaft 234*c* and the contact surface of the movement stopper 234 and the paper stopper 235, and A1 and A2 are rotation directions of the movement stopper 234. A1 is perpendicular to L1 and A2 is perpendicular to L2.

As shown in FIG. 5*d*, the rotation direction A1 has no resistance from the front end of the paper stopper 235 so that the hook 234*a* can be easily separated from the hook 235*a*. But, as shown in FIG. 5*e*, the rotation direction A2 has a resistance in the path from the front end of the paper stopper 235 so that the hook 234*a* cannot be easily separated from the hook 235*a* or cannot be separated from the hook 235*a* at all. The operating principle describe above can be used to design the structures and engagement of the movement stopper 234 and the paper stopper 235. Thus, in other embodiments, the structures and relative positions of the movement stopper 234 and the paper stopper 235 are not limited to what have been illustrated in the drawings.

Of course, when a relatively large force is needed to disengage the movement stopper 234 and the paper stopper 235, the structures as shown in FIG. 5*a* guarantee that the hook 234*a* is able to hook up with the paper stopper 235 and disengagement is not likely to occur. Thus, many conditions may be factored in regarding the angle between the contact surface of the movement stopper 234 and the paper stopper 235 and the horizontal surface. It is not sufficient to only consider the thrust F applied to the paper stopper 235 from the paper sheet P after the paper sheets P is drawn into the paper entry opening 241. These factors include a supporting force of the torsion spring 235*b* against the paper stopper 235, a distance between the paper stopper pivot shaft 235*c* and the contact surface of the movement stopper 234 and the paper stopper 235, and a distance between the movement stopper pivot shaft 234*c* and contact surface of the movement stopper 234 and the paper stopper 235, etc.

The structure of the paper stopper 235 will be described below with reference to FIGS. 6 and 7, and FIGS. 2-5*e*.

Generally, only one paper stopper 235 is necessary to be configured in the paper feed path 24. However, in one embodiment, two paper stoppers 235 are configured.

Figure 6:
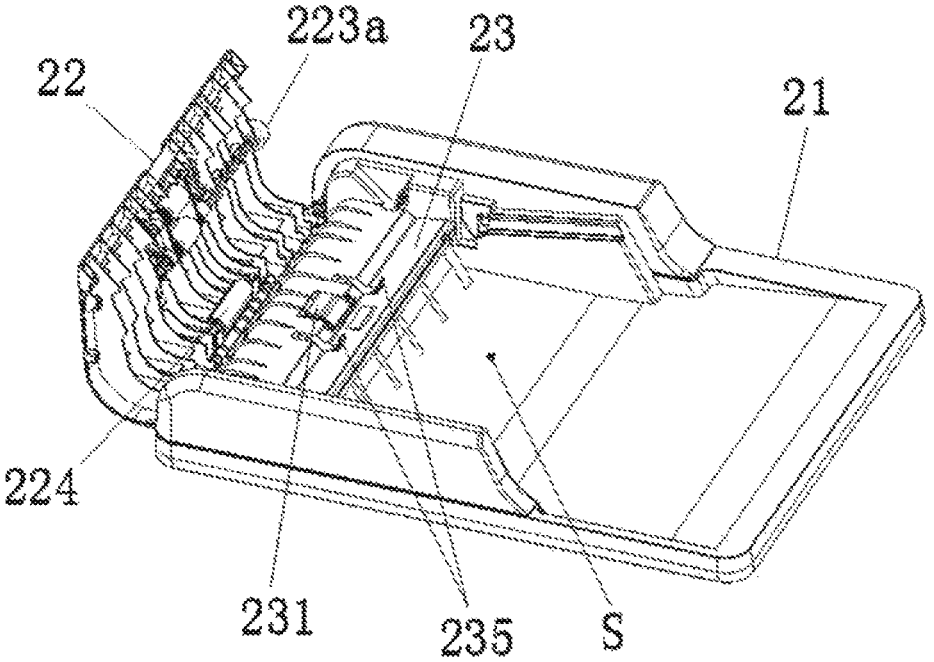
FIG. 6 illustrates a schematic diagram of a cover of a scanning unit and a paper feed unit in an open state according to the disclosed embodiments.

As shown in FIG. 6, two paper stoppers 235 are configured on both sides of the separator 231, respectively. Accordingly, two movement stoppers 234 are configured on both sides of the paper feed roller holder 222, respectively, corresponding to the two paper stoppers 235. In this case, the two paper stoppers 235 can also function as paper guides. When a paper sheets P is pushed into the paper feed path 24, both paper stoppers 235 are pushed forward against the two movement stoppers 234 at the same time, and stop swinging, causing the front end of the paper sheet P to be blocked outside the paper feed path 24. The movement stoppers 234 and the paper stoppers 235 are disposed in positions parallel with cross-section plane of the paper feed path 24.

In addition, the paper guides 251 on the paper tray 25 can be coordinated to further improve the paper feed operation, and significantly reduce the occurrences of paper misalignment and paper jam. The two parallel configured paper stoppers 235 form a plane, which is perpendicular to the vertical plane where the paper feed path of the image forming apparatus including the disclosed paper stopper structure is located. The two paper stoppers 235 are also able to correct the alignment of the front end of the paper sheet, preventing misalignment after the paper sheet enters into the paper feed path 24.

Figure 7:
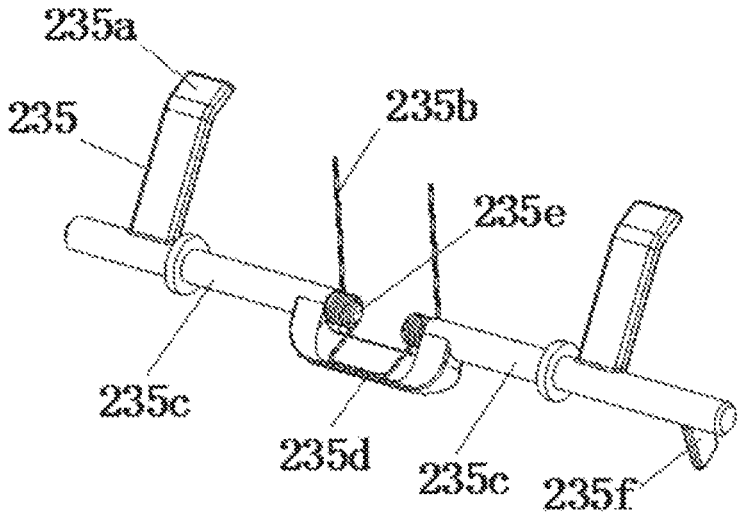
FIG. 7 illustrates a schematic diagram of an exemplary paper stopper according to the disclosed embodiments.

The two stoppers 235 may be disposed separately. In one embodiment, as shown in FIG. 7, each of the two paper stoppers 235 is fixed to a paper stopper pivot shaft 235*c*, respectively. A bridge portion 235*d* is configured between the two adjacent ends of the two paper stopper pivot shafts 235*c*, and the other two ends are attached to the conveying frame 23. A positioning structure is configured on each end of the two paper stopper pivot shafts 235*c* closer to the bridge portion 235*d* for positioning the corresponding torsion spring 235*b*. The positioning structure may be a protrusion 235*e* to which the torsion spring 235*b* is fitted. One end, of the torsion spring 235*b* is attached to the bridge portion 235*d*, and the other end is attached to the conveying frame 23. The torsion spring 235*b* may be two separate parts. Of course, the torsion spring 235*b* may be integrally formed as a single part, and it may be more convenient to process, manage, and assemble thereof.

The design of the two paper stoppers 235 as a coordinated structure also has other advantages. As shown in FIG. 7, a sensing portion 235*f* is configured on the outer surface of one of the paper stopper pivot shaft 235*c*. The sensing portion 235*f* corresponds to the sensor 243. As the paper stopper pivot shaft 235*c* swings, the sensing portion 235*f* may be inserted into or separated from the sensor 243 such that the sensor 243 is turned on and off. Because the two paper stoppers 235 are coordinated, only one of the two paper stopper pivot shafts 235*c* needs to be configured with the sensing portion 235*f*. Accordingly, only one sensor 243 is needed. Of course, it is also feasible that two sensing portions 235*f* are configured on the outer surface of the two paper stopper pivot shafts 235*c*, and two sensors 243 are configured to correspond to the two sensing portions 235*f*.

The above describes the cases where one and two paper stoppers 235 are used in the embodiments of the present invention. Based on the actual needs, such as paper width and paper weight, more than two paper stoppers 235 may be configured. A plurality of paper stoppers may be connected by a lever so that the plurality of the paper stoppers 235 may swing simultaneously. Accordingly, a plurality of movement stoppers 234 may be configured on the paper feed roller holder 222. The plurality of the movement stoppers 234 may be connected by a lever so that the plurality of the movement stopper 234 may swing simultaneously.

Figure 8:
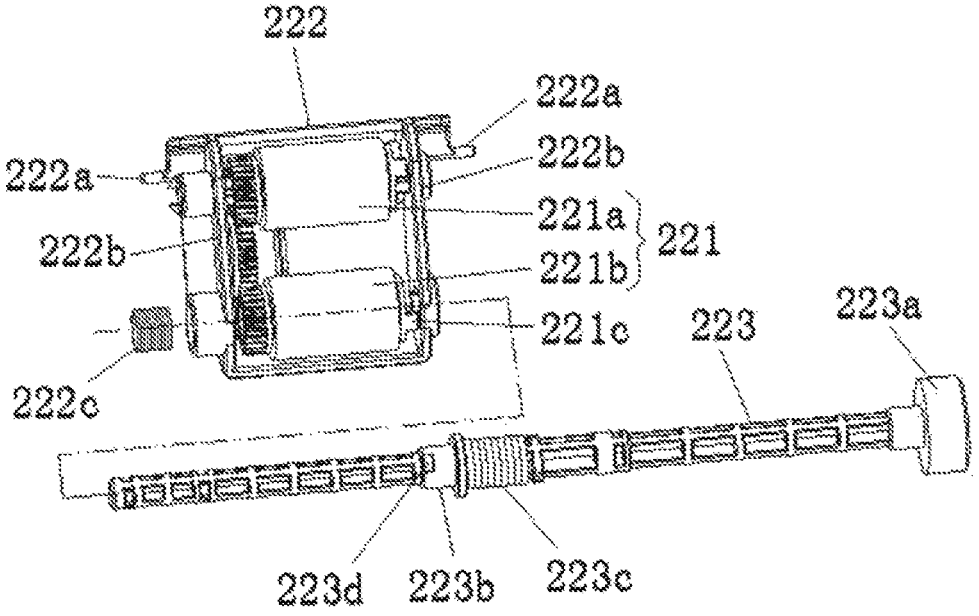
FIG. 8 illustrates a schematic diagram of an exemplary paper feed roller, a paper feed roller holder, and a drive shaft according to the disclosed embodiments.

The structure, installation, and operating principle of the paper feed roller 221, the paper feed roller holder 222, and the driving shaft 223 will be described in the following with reference to FIGS. 6 and 8.

A mounting plate 222*b* is configured on each of the two sides of the paper feed roller holder 222. A section for receiving the paper feed rollers 221 is formed between the two mounting plates 222*b*. Each of the two mounting plates 222*b* is configured with a through-hole such that the driving shaft 223 may pass through the paper feed roller 221 and the paper feed roller holder 222.

Generally, the paper feed roller set mounted on the paper feed roller holder 222 can also be specifically configured based on functionalities. For example, different paper feed rollers may be configured for drawing paper sheets and preventing paper mis-feed, respectively. Specifically, the paper feed roller set may be divided into a paper draw roller 221*a* primarily for drawing paper sheets, and a paper separation roller 221*b* primarily for preventing paper mis-feed.

The function of the paper draw roller 221*a* is only for drawing paper sheets, and paper mis-feed may still occur. Then, the paper separation roller 221*b*, corresponding to the separator 231, ensures that only one paper sheet at a time enters the path feed path 24. The operating, principle of effectively preventing a plurality of paper sheets from entering the paper feed path 24 has been described previously, and is not repeated herein. In order to keep the same rotation directions of the paper draw roller 221*a* and the paper separation roller 221 *b*, an idle roller may be configured to connect the paper draw roller 221*a* and the paper separation roller 221*b*.

In one embodiment, in the state as shown in FIG. 4*b*, the paper stopper 235 is preferably configured between the paper draw roller 221*a* and the paper separation roller 221*b*. It is most preferable to ensure that the paper stopper 235 is located between the paper draw roller 221*a* and the paper separation roller 221*b* when the paper stopper 235 is in the paper stopping state, i.e., a second position. When paper feed roller holder 222 swings downward, such configuration makes the paper draw roller 221*a* contact the paper sheet P. Further, when in the second position, the paper stopper 235 is almost perpendicular to the horizontal plane, or is perpendicular the paper feeding angle. Thus, the paper sheets P can be placed more neatly in the natural state, and the feeding process of the paper sheets P is smoother.

One end of the driving shaft 223 passes through the paper draw roller 221*a*, and the other end is configured with a gear wheel 223*a* which is connected to a driving structure, generally a separate electric motor, and is driven by the electric motor. A drive head 223*b* and a unidirectional spring member 223*c* are fitted over the driving shaft 223. The drive head 223*b* is rotatable on the driving shaft 223. A portion of the unidirectional spring member 223*c* is fitted outside the drive head 223*b*, and another portion is fitted on the driving shaft 223. One end of the unidirectional spring member 223*c* is attached to the driving shaft 223, and the other end is not attached to the drive head 223*b*. The drive head 223*b* is able to rotate relatively between the unidirectional spring member 223*c* and the driving shaft 223.

In one embodiment, the iron core cross-section area of the unidirectional spring member 223*c* is in a rectangular shape. By configuring the unidirectional spring member 223*c*, at least the following functions may be achieved. When the driving shaft 223 rotates in the winding direction of the unidirectional spring member 223*c*, the inner and the outer diameters of the unidirectional spring member 223*c* are tightened to hold the drive head 223*b* fittingly. With the continuous rotation of the unidirectional spring member 223*c*, the drive head 223*b* also rotates driven by the driving shaft 223. Subsequently, the drive head 223*b* drives the paper feed roller 221 to rotate. When the driving shaft 223 rotates in a reverse direction, the inner and outer diameters of the unidirectional spring member 223*c* are loosened, allowing the drive head 223*b* to rotate freely it the unidirectional spring member 221*c*.

A drive protrusion 223*d* is configured on the outer surface of the drive head 223*b*. A stopper 221*c* is configured on the shaft end of the paper feed roller 221, corresponding to the drive protrusion 223*d*. When the drive head 223*b* rotates by a certain angle, the drive protrusion 223*d* comes into contact with the stopper 221*c*, causing the drive head 223*b* to drive the paper feed roller 221 to rotate.

The unidirectional spring member 223*c*, the drive head 223*b*, and the stopper 221*c* are configured on the mounting plate 222*b* on the same side of the paper feed roller holder 222. A resistance spring member 222*c* is configured on the mounting plate 222*b* on the other side of the paper feed roller holder 222. The resistance spring, member 222*c* is fitted over the outer diameter of the driving shaft 223, and maintains a certain frictional force with the drive shaft 223. At the same, the resistance spring member 222*c* maintains a certain frictional force with the inner side of the through-hole of the mounting plate 222*b*.

Because the paper feed roller holder 222 is not attached to the driving shaft 223 or the drive head 223*b*, when the driving shaft 223 rotates, the paper feed roller 221 is driven by the driving shaft 223 and the drive head 223*b* to rotate. However, the paper feed roller holder 222 does not rotate with the paper feed roller 221.

By configuring the resistance spring member 222*c*, at the following functions may be achieved. The resistance spring member 222*c* is able to provide a certain frictional force to swing the paper feed roller holder 222 when the driving shaft 223 rotates back and forth in the opposite directions. When the drive shaft 223 rotates in clockwise, the paper feed roller holder 222 swings downward until the paper feed roller 221 comes into contact with the paper sheets. In this case, no matter how thick the paper sheet stack. Is in the paper tray 25, the paper feed roller 221 always comes into contact with the paper sheets, and provides a stable pressure to the paper feed roller holder 222 so that the paper feed roller 221 has a sufficient frictional force to draw paper sheets.

When the driving shaft 223 rotates counterclockwise, the paper feed roller holder 22 swings upward so that the paper feed roller 221 moves away from the paper sheets until the paper feed roller holder 222 comes into contact with the lid 22, and the electric motor stops the reverse rotation, causing the paper feed roller holder 222 to maintain a certain height. Of course, the resistance spring member 222*c* is only an exemplary embodiment. Alternatively, a rubber ring or the like that provides a certain frictional force may be used.

The paper feeding method of the disclosed embodiments of the present invention is primarily used for feeding paper sheets into an image forming apparatus. The image forming apparatus includes a paper feed path 24, a driving shaft 223, and the above described paper stop structure. The paper feed path 24 includes a paper entry opening 241. A paper feed roller set rotated when driven by the driving shaft 223 is configured inside the paper feed path 24.

Figure 9:
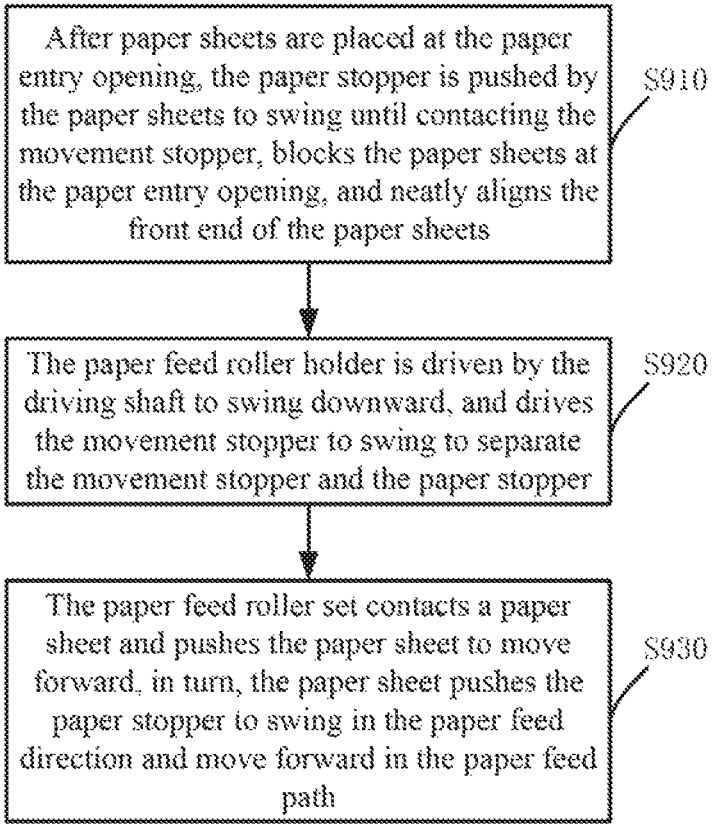
FIG. 9 illustrates a flow chart of an exemplary paper feed method according to the disclosed embodiments.

Referring to the above described image forming apparatus, as shown in FIG. 9, the method primarily includes the following steps.

Step S910: after the paper, sheets are inserted to the paper entry opening 241, the paper stopper 235 is pushed by the thrust from the paper sheets to swing until coming into contact with the movement stopper 234, causing the paper sheets to be blocked at the paper entry opening 241. By configuring two paper stoppers 235, the front end of the paper sheets are neatly or straightly aligned.

Step S920: the paper feed roller holder 222 is driven by the driving shaft 223 to swing downward, and the movement stopper 234 is driven to swing, separating the movement stopper 234 and the paper stopper 235.

Step S930: the paper feed roller contacts and drives the paper sheets forward, and the paper sheets push the paper stopper 235 to swing in the paper sheet feeding direction and move forward in the paper feed path 24.

In one embodiment, when the paper sheets are used up, the pressure against the paper stopper 235 by the paper sheets disappears, and the separation structure makes the paper stopper 235 reset and swing toward the paper entry opening 241. The driving shaft 223 rotates reversely and drives the paper feed roller holder 222 to swing upward. The movement stopper 234 is driven by the paper feed roller holder 222 to swing and block the paper feed path 24.

In one embodiment, by coordinating the paper feed roller holder, the movement stopper, and the paper stopper, functions such as paper feeding, paper stopping, and paper inspecting may be achieved. Further, large capacity paper feeding can be achieved to improve the operating efficiency of the product. It is also effective to prevent the occurrences of paper mis-feed and paper jam during the operation of an image forming apparatus such as a printer.

Although various embodiments of the present invention are disclosed, the descriptions are merely for the purpose of facilitating the understanding of the embodiments of the present invention, and are not intended to limit the present invention. It should be understood by those skilled in the art that various changes and modifications in form and details may be made therein without departing from the spirit and scope of the present invention as defined by the appended claims.

What is claimed is:

1. A paper stop structure of an image forming apparatus, comprising:

a movement stopper swingably configured in a paper feed path;

a paper stopper swingably configured in the paper feed path; and a separation structure configured to separate the movement stopper and the paper stopper, wherein:

when the paper stop structure is in a paper stopping state, the paper stopper is pushed by an external force to swing until the paper stopper comes into contact with the movement stopper, stops swinging, and blocks paper sheets from entering the paper feed path;

when the paper stop structure is not in the paper stopping state, the paper stopper is pushed by an external force to swing, and separates itself from the movement stopper;

the paper stop structure includes two or more paper stoppers and the corresponding movement stoppers;

when the paper stoppers swing together, the paper stoppers hook up or disengage with the respective movement stoppers simultaneously; and a plurality of paper stoppers is configured on a single paper stopper pivot shaft.

2. The paper stop structure of claim 1, wherein:

the separation structure includes two torsion springs configured on two paper stopper pivot shafts located on both sides of the paper stopper; and one end of the torsion springs is attached to the paper stopper.

3. The paper stop structure of claim 1, wherein:

the paper stoppers are configured in parallel;

the movement stoppers are configured in parallel; and a plane formed by the paper stoppers in parallel is perpendicular to a vertical plane where the paper feed path of the image forming apparatus having the paper stop structure is located.

4. The paper stop structure of claim 1, wherein:

when a plurality of paper stoppers is configured on a plurality of paper stopper pivot shafts respectively, the plurality of the paper stopper pivot shafts are arranged in a straight line; and a plurality of positioning structures is configured on the adjacent ends of the plurality of the paper stopper pivot shafts to position the torsion springs.

5. The paper stop structure of claim 4, wherein:

each pair of adjacent ends of the paper stopper pivot shafts is connected by a bridge portion; and one end of each torsion spring is attached to a bridge portion.

6. A paper feed unit of an image forming apparatus, comprising:

a press cover with a lid hinged to the press cover, a paper feed roller holder being configured on the lid;

a conveying frame coupled with the press cover and the lid to form a paper feed path;

a paper stop structure, including:

a movement stopper swingably configured in the paper feed path;

a paper stopper swingably configured inside the paper feed path; and a separation structure configured to separate the movement stopper and the paper stopper, wherein when the paper stop structure is in a paper stopping state, the paper stopper is pushed by an external force to swing until the paper stopper comes into contact with the movement stopper, stops swinging, and blocks paper sheets from entering the paper feed path; and when the paper stop structure is not in the paper stopping state, the paper stopper is pushed by an external force to swing, and separates itself from the movement stopper, wherein:

the movement stopper is hinged to the lid by movement stopper pivot shafts located on both sides of the movement stopper;

the paper stopper is attached to the conveying frame through paper stopper pivot shafts located on both sides of the paper stopper;

the movement stopper operates in coordination with the paper feed roller holder through a guide structure;

an end of the movement stopper is pulled by the paper feed roller holder to swing; and when the paper stop structure includes two or more paper stoppers and the separation structure includes a torsion spring, one end of the torsion spring is connected to a bridge portion between two adjacent ends of the paper stopper pivot shafts, and the other end of the torsion spring is connected to the conveying frame.

7. The paper feed unit of claim 6, wherein:

a guide protrusion is configured on one of the paper feed roller holder and the movement stopper; and a guide slot is configured on the other of the paper feed roller holder and the movement stopper, corresponding to the guide protrusion.

8. The paper feed unit of claim 6, wherein:

the separation structure is an elastic spring or a torsion spring;

when the separation structure is an elastic spring, one end of the elastic spring is connected to the paper stopper, and the other end of the spring is connected to the conveying frame; and when the separation structure is a torsion spring, one end of the torsion spring is connected to the paper stopper, and the other end of the torsion spring is connected to the conveying frame.

9. The paper feed unit of claim 6, wherein:

a paper feed roller set is mounted on the paper feed roller holder;

the paper feed roller set includes a paper draw roller for drawing paper sheets and a separation roller for coordinating with a separator to prevent paper mis-feed; and the paper stopper is configured between the paper draw roller and the paper separation roller.

10. The paper feed unit of claim 6, wherein:

a sensor is configured inside the paper feed path for sensing paper stopper position change;

a sensing portion is configured on a paper stopper pivot shaft, corresponding to the sensor; and when the paper stopper pivot shaft swings, the sensing portion approaches or moves away from the sensor.

11. An image forming apparatus comprising a paper feed unit of claim 6, further including:

an image forming unit; and a scanning unit located above the image forming unit and below the paper feed unit, wherein the paper feed unit feeds paper sheets to the scanning unit and the press cover of the paper feed unit rotates to cover the scanning unit.

12. The image forming apparatus of claim 11, wherein:

the separation structure in the paper stop structure includes two torsion springs configured on two paper stopper pivot shafts located on both sides of the paper stopper; and one end of the torsion springs is attached to the paper stopper.

13. The image forming apparatus of claim 12, wherein:

the paper stop structure includes two or more paper stoppers and the corresponding movement stoppers; and when the paper stoppers swing together, the paper stoppers hook up and disengage with the respective movement stoppers simultaneously.

14. The image forming apparatus of claim 13, wherein:

the paper stoppers are configured in parallel;

the movement stoppers are configured in parallel; and a plane formed by the paper stoppers in parallel is perpendicular to a vertical plane where the paper feed path of the image forming apparatus having the paper stop structure is located.

15. The image forming apparatus of claim 13, wherein:

a plurality of paper stoppers is configured on a single paper stopper pivot shaft or a plurality of paper stopper pivot shafts.

16. The image forming apparatus of claim 11, wherein:

a guide protrusion is configured on one of the paper feed roller holder and the movement stopper; and a guide slot is configured on the other of the paper feed roller holder and the movement stopper, corresponding to the guide protrusion.

17. The image forming apparatus of claim 11, wherein:

a sensor is configured inside the paper feed path for sensing paper stopper position change;

a sensing portion is configured on a paper stopper pivot shaft, corresponding to the sensor; and when the paper stopper pivot shaft swings, the sensing portion approaches or moves away from the sensor.

* * * * *